US012070789B2

(12) United States Patent
Onagi et al.

(10) Patent No.: US 12,070,789 B2
(45) Date of Patent: Aug. 27, 2024

(54) METHOD OF ARRANGING DIVIDED TOOL AND PRESS BRAKE

(71) Applicant: AMADA CO., LTD., Kanagawa (JP)

(72) Inventors: Yousuke Onagi, Kanagawa (JP); Yuto Nishihata, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 300 days.

(21) Appl. No.: 17/782,651

(22) PCT Filed: Dec. 1, 2020

(86) PCT No.: PCT/JP2020/044624
§ 371 (c)(1),
(2) Date: Jun. 5, 2022

(87) PCT Pub. No.: WO2021/117541
PCT Pub. Date: Jun. 17, 2021

(65) Prior Publication Data
US 2022/0388052 A1 Dec. 8, 2022

(30) Foreign Application Priority Data
Dec. 11, 2019 (JP) ..... 2019-223622

(51) Int. Cl.
*B21D 37/04* (2006.01)
*B21D 5/02* (2006.01)

(52) U.S. Cl.
CPC ..... *B21D 37/04* (2013.01); *B21D 5/02* (2013.01)

(58) Field of Classification Search
CPC ..... B21D 5/0254; B21D 37/04; B21D 5/004
See application file for complete search history.

(56) References Cited

U.S. PATENT DOCUMENTS

2022/0314295 A1 10/2022 Watanabe

FOREIGN PATENT DOCUMENTS

EP 3967418 A1 3/2022
JP 03-53047 B2 8/1991
JP 06-190448 A 7/1994
(Continued)

OTHER PUBLICATIONS

Extended European Search report for corresponding EP Application No. 20900560.2 dated Dec. 13, 2022.
(Continued)

*Primary Examiner* — Bobby Yeonjin Kim
(74) *Attorney, Agent, or Firm* — Renner, Otto, Boisselle & Sklar, LLP

(57) ABSTRACT

In a first step, a pulling operation is performed with respect to four tools by retaining, in an immovable state, a leftmost tool from among the four tools lined up on a tool mounting unit by means of a left ATC and by moving, toward the left ATC, a rightmost tool from among the four tools by means of a right ATC. In a second step, a movement of the right ATC is stopped when a torque of a motor for moving the right ATC in a left-right direction reaches a preset set value. The first step includes a choosing step of choosing, for the respective left and right ATCs, whether to perform the pulling operation in a state of being abutted against respective side surfaces of the tools or to perform the pulling operation in a state of being engaged with respective engagement holes of the tools.

8 Claims, 10 Drawing Sheets

(56) References Cited

FOREIGN PATENT DOCUMENTS

| | | | | |
|---|---|---|---|---|
| JP | 2000-71028 | A | 3/2000 | |
| JP | 2014-91137 | A | 5/2014 | |
| JP | 2019-118951 | A | 7/2019 | |
| JP | 2019-122972 | A | 7/2019 | |
| WO | WO-2018211381 | A1 * | 11/2018 | ..... B21D 5/00 |

OTHER PUBLICATIONS

International Search Report for corresponding Application No. PCT/JP2020/044624, mailed Feb. 16, 2021.
Written Opinion for corresponding Application No. PCT/JP2020/044624, mailed Feb. 16, 2021.

* cited by examiner

METHOD OF ARRANGING DIVIDED TOOL AND PRESS BRAKE

TECHNICAL FIELD

The present disclosure relates to a method of arranging a divided tool for mounting a plurality of divided tools by using an ATC (automatic tool changer) with respect to a tool mounting unit of a press brake, and the press brake. More specifically, the present disclosure relates to an arrangement method by which, when a plurality of divided tools are mounted by using the ATC with respect to the tool mounting unit of the press brake, the divided tools can be arranged in a state of being in contact (abutted) with each other without creating minute gaps between the respective divided tools, and the press brake used for the arrangement method.

BACKGROUND ART

When a plate-shaped workpiece is bent in a press brake, an upper tool and a lower tool are mounted on upper and lower tables, respectively. Then, the workpiece is supplied and positioned between the upper and lower tools, and the workpiece is bent into a V shape by causing the upper and lower tools to be engaged with each other. Conventionally, installation and removal of the upper and lower tools to and from the upper and lower tables are performed in correspondence to a bending line length of the workpiece. In this case, a plurality of tools corresponding to the bending length of the workpiece are required. Therefore, there is a problem that storage and management of the tools are troublesome.

Then, in recent years, it has become possible to correspond to the bending length of the workpiece by combining a plurality of types of divided tools having different width dimensions. In this case, the installation and removal of the divided tools to and from the tool mounting units provided on the upper and lower tables in the press brake are automatically performed by using an ATC (automatic tool changer) (for example, see Patent Literatures 1 and 2).

CITATION LIST

Patent Literature

Patent Literature 1: Japanese Patent Application Laid-Open Publication No. 2000-71028

Patent Literature 2: Japanese Patent Application Laid-Open Publication No. 2014-91137

SUMMARY

Now, when the plurality of divided tools are mounted by using the ATC with respect to the tool mounting units provided on the upper and lower tables, a pulling operation is performed by the ATC after the plurality of divided tools are arranged at tentative positions of the tool mounting units so as to bring the respective tools into close contact with each other (see, for example, a description of [0061] in Patent Literature 1). In this case, position control of a motor provided to the ATC is performed based on information of a position of an encoder provided to the motor, by referring to information of a position at which the divided tool is to be positioned, information of a length of the combined divided tool, and the like.

Therefore, even when the ATC is positioned accurately at a position instructed in the position control by performing the pulling operation, small gaps may remain between the respective divided tools due to, for example, a backlash of a drive unit, a slight deflection of a finger supporting the divided tool at the end portion, a drawing tolerance of the divided tools being negative, and the like.

In other words, when the ATC is positioned by means of the position control and the pulling operation of the divided tools are performed, minute gaps may remain between the respective divided tools even when the ATC is positioned accurately at the instructed position. As a result, a bending scratch may be caused, for example.

The present disclosure has been made in view of such a problem, and an object thereof is to suppress, even when a plurality of divided tools are combined, an occurrence of gaps between the respective divided tools.

In order to solve such a problem, a first aspect of one or more embodiments is a method of arranging a divided tool, the method arranging a plurality of divided tools with respect to a tool mounting unit in a press brake by using a first automatic tool changer and a second automatic tool changer for performing installation and removal of a divided tool to and from the tool mounting unit by retaining the divided tool in a state of being engaged with an engagement hole in a front-rear direction provided to the divided tool, the method including a first step of performing a pulling operation with respect to the plurality of divided tools by retaining, in an immovable state, a divided tool on one end side in a left-right direction from among the plurality of divided tools lined up on the tool mounting unit by means of the second automatic tool changer and by moving, toward the second automatic tool changer, a divided tool on another end side in the left-right direction from among the plurality of divided tools by means of the first automatic tool changer, and a second step of stopping a movement of the first automatic tool changer when a torque of a motor for moving the first automatic tool changer in the left-right direction reaches a preset set value, the first step including a choosing step of choosing, for each of the first and second automatic tool changers, whether to perform the pulling operation in a state of being abutted against a side surface of the divided tool or to perform the pulling operation in a state of being engaged with an engagement hole of the divided tool.

Further, a second aspect of the one or more embodiments is a method of arranging a divided tool, the method arranging a plurality of divided tools with respect to a tool mounting unit in a press brake by using a first automatic tool changer and a second automatic tool changer for performing installation and removal of a divided tool to and from the tool mounting unit by retaining the divided tool in a state of being engaged with an engagement hole in a front-rear direction provided to the divided tool, the method including a first step of performing a pulling operation with respect to the plurality of divided tools by retaining, in an immovable state, a divided tool on one end side in a left-right direction by means of the second automatic tool changer abutted against a side surface of the divided tool on the one end side from among the plurality of divided tools lined up on the tool mounting unit and by moving, toward the second automatic tool changer, a divided tool on another end side in the left-right direction by means of the first automatic changer abutted against a side surface of the divided tool on the other end side from among the plurality of divided tools, a second step of stopping a movement of the first automatic tool changer when a torque of a motor for moving the first automatic tool changer in the left-right direction reaches a preset set value, and a third step of moving the first automatic tool changer in the left-right direction to separate the first automatic tool changer from the divided tool on the other end side and moving the second automatic tool changer in the left-right direction to separate the second automatic tool changer from the divided tool on the one end side.

Further, a third aspect of the one or more embodiments is a press brake including a table provided with a tool mounting unit for mounting a divided tool, a first automatic tool changer and a second automatic tool changer configured to mount the divided tool with respect to the tool mounting unit by retaining the divided tool in a state of being engaged with an engagement hole in a front-rear direction provided to the divided tool, a control device configured to control the first and second automatic tool changers to perform a pulling operation with respect to a plurality of divided tools lined up on the tool mounting unit along a left-right direction, and a torque detection unit configured to detect a torque of a motor for moving the first automatic tool changer in the left-right direction. The control device chooses, for each of the first and the second automatic tool chargers, whether to perform the pulling operation in a state of being abutted against a side surface of the dividing tool or to perform the pulling operation in a state of being engaged with the engagement hole of the dividing tool, performs the pulling operation by retaining, in an immovable state, a divided tool on one end side in the left-right direction from among the plurality of divided tools by means of the second automatic tool changer and moving, toward the second automatic tool changer, a divided tool on another end side in the left-right direction from among the plurality of divided tools by means of the first automatic tool changer, and compares a preset set value and a detected value detected by the torque detection unit and stops a movement of the first automatic tool changer when the detected value is equal to the set value.

Still further, a fourth aspect of the one or more embodiments is a press brake including a table provided with a tool mounting unit for mounting a divided tool, a first automatic tool changer and a second automatic changer configured to mount a plurality of divided tools with respect to the tool mounting unit by retaining the divided tool in a state of being engaged with an engagement hole in a front-rear direction provided to the divided tool, a control device configured to control the first and second automatic tool changers to perform a pulling operation with respect to the plurality of divided tools lined up on the tool mounting unit along a left-right direction, and a torque detection unit configured to detect a torque of a motor for moving the first automatic tool changer in the left-right direction. The control device performs the pulling operation by retaining, in an immobile state, a divided tool on one end side in the left-right direction by means of the second automatic tool changer abutted against a side surface of the divided tool on the one end side from among the plurality of divided tools and moving, toward the second automatic tool changer, a divided tool on another end side in the left-right direction by means of the first automatic tool changer abutted against a side surface of the divided tool on the other end side from among the plurality of divided tools, compares a preset set value and a detected value detected by the torque detection unit and stops a movement of the first automatic tool changer when the detected value is equal to the set value, and after the movement of the first automatic tool changer is stopped, moves the first automatic tool changer in the left-right direction to separate the first automatic tool changer from the divided tool on the other end side and moves the second automatic tool changer in the left-right direction to separate the second automatic tool changer from the divided tool on the one end side.

According to the present disclosure, even when a plurality of divided tools are combined, it is possible to suppress an occurrence of gaps between the respective divided tools.

DESCRIPTION OF EMBODIMENTS

First Embodiment

Hereinafter, a press brake according to the present embodiment will be described with reference to the drawings. Now, in the press brake, a configuration in which upper and lower divided tools are automatically changed by using an automatic tool changer (ATC) is publicly known as described in, for example, Patent Literatures 1 and 2. Therefore, for ease of understanding, the overall configuration of the press brake will be outlined.

Figure 1:
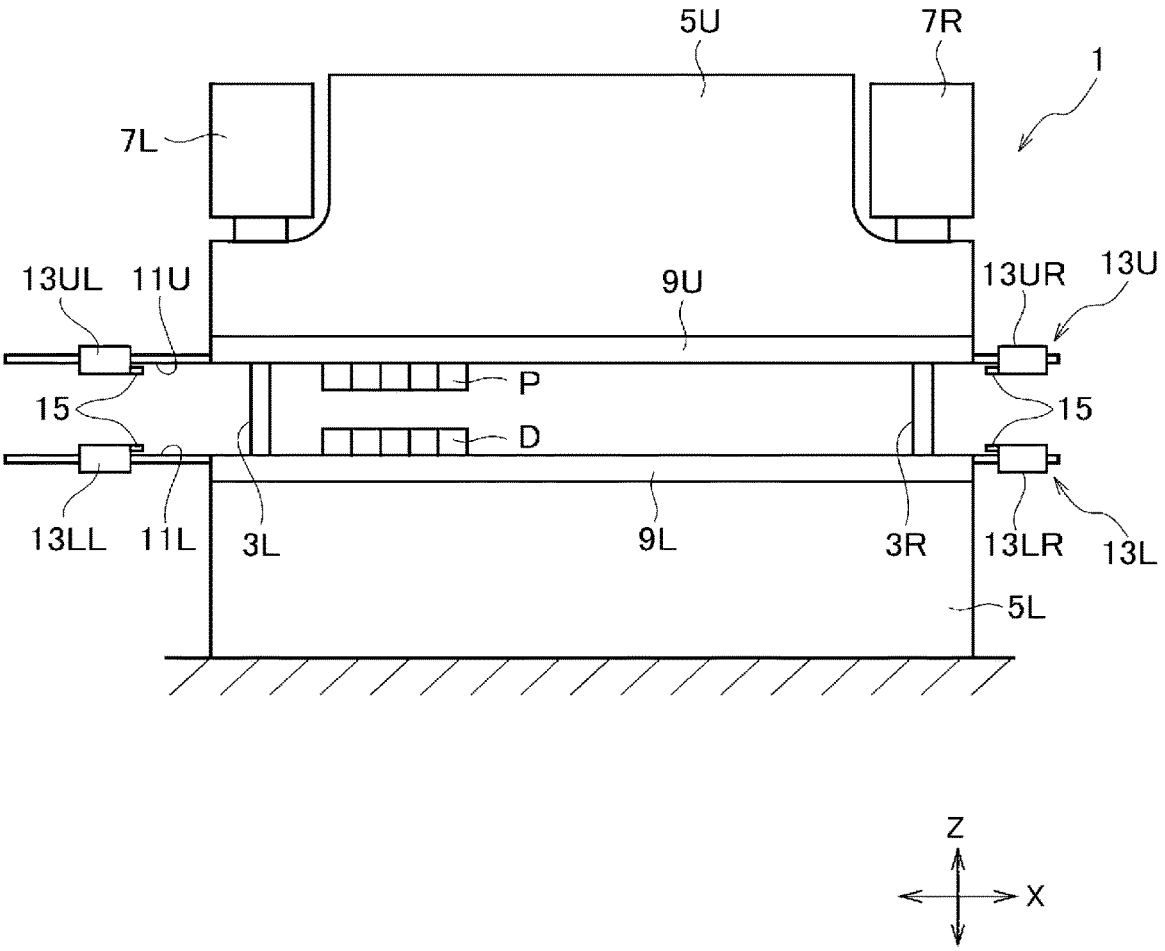
FIG. 1 is a front explanatory diagram conceptually and schematically showing a configuration related to a press brake according to the present embodiment.

With reference to FIG. 1, a press brake 1 according to the present embodiment includes left and right side frames 3L and 3R. An upper table 5U is provided on the upper parts of the side frames 3L and 3R. Further, a lower table 5L facing the upper table 5U vertically (in the Z-axis direction) is provided on the lower parts of the side frames 3L and 3R. The upper table 5U is configured as a ram that is moved up and down by vertically actuating devices 7L and 7R such as hydraulic cylinders, for example, that are mounted on the side frames 3L and 3R.

Tool mounting units 9U and 9L are provided to the upper and lower tables 5U and 5L in the left-right direction (the X-axis direction) for mounting the upper and lower tools (divided tools) P and D. Then, guide members 11U and 11L in the right-left direction are provided on the rear side (the rear side in the Y-axis direction) of the upper and lower tables 5U and 5L. The upper and lower guide members 11U and 11L are provided with upper and lower automatic tool changers (ATCs) 13U and 13L for performing installation and removal of the tools P and D between a tool storage unit (not shown in FIG. 1) and the tool mounting units 9U and 9L, respectively.

A pair of left and right ATCs 13UL, 13UR, 13LL, and 13LR are provided to the upper and lower ATCs 13U and 13L so as to be movable in the left-right direction along the upper and lower guide members 11U and 11L, respectively. Each of the ATCs 13UL, 13UR, 13LL, and 13LR can be individually moved and positioned in the left-right direction by individually controlling and driving an individually provided motor (for example, a servomotor (not shown)) under the control of a control device (not shown). The configurations of the ATCs 13UL, 13UR, 13LL, and 13LR are publicly known as described in WO 00/41824, for example. Therefore, a detailed description of the configuration of each ATC will be omitted.

As described above, the upper and lower ATCs 13U and 13L perform the installation and removal of the upper and lower tools P and D to and from the upper and lower tool mounting units 9U and 9L, respectively. In order to perform the installation and removal of the upper and lower tools P and D, the respective ATCs 13UL, 13UR, 13LL, and 13LR are provided with tool retention members (fingers) 15 that can be engaged with engagement holes PH and DH in the front-rear direction provided to the upper and lower tools P and D, respectively (see FIG. 2). The respective ATCs 13UL, 13UR, 13LL, and 13LR cause the tool retention members 15 to be engaged with (inserted into) the engagement holes PH and DH of the upper and lower tools P and D, and perform the installation and removal of the upper and lower tools P and D in a state of retaining the upper and lower tools P and D.

Figure 2:
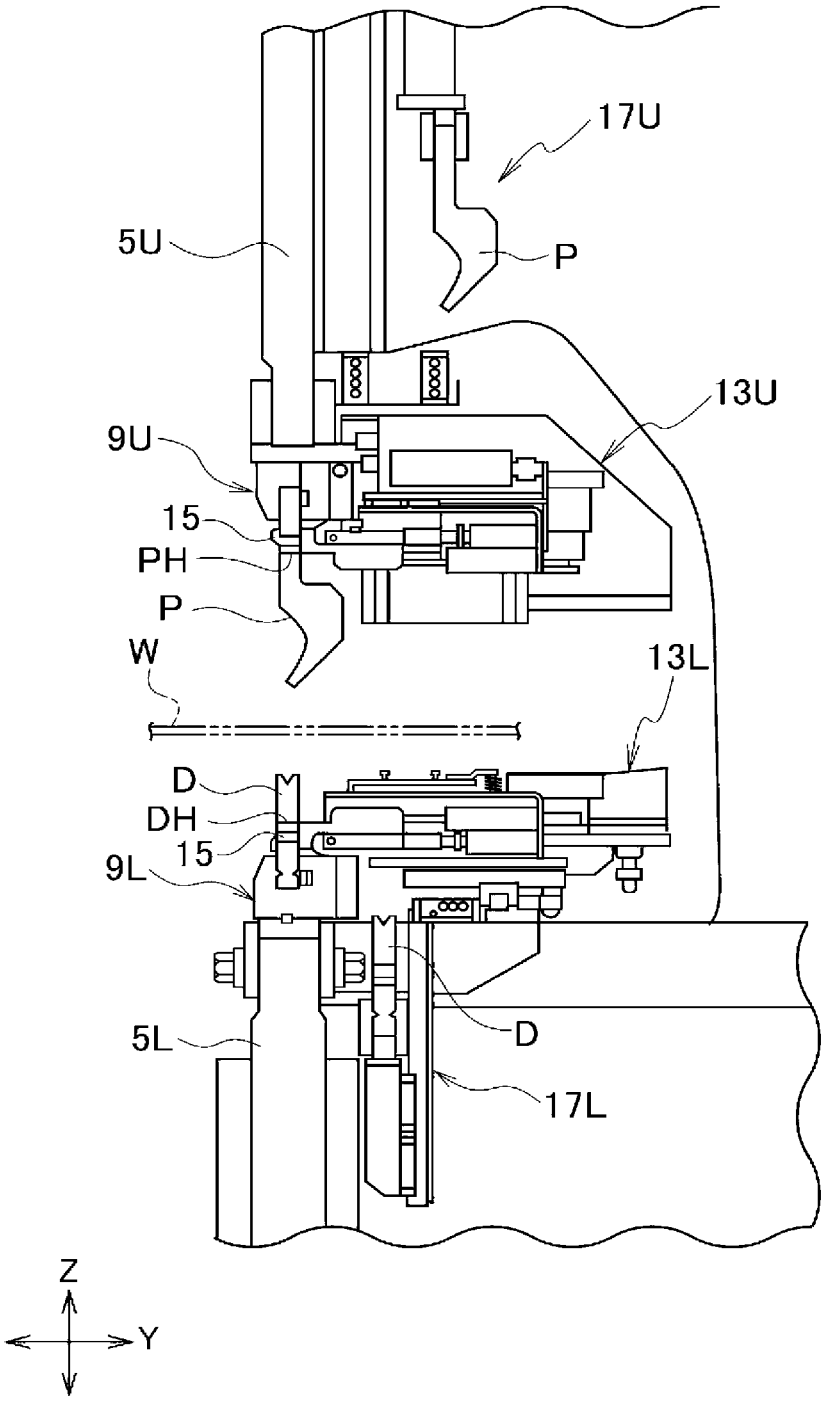
FIG. 2 is an explanatory diagram of a side cross section of the press brake.

In order to be engaged with or be disengaged from the engagement holes PH and DH of the tools P and D mounted on the tool mounting units 9U and 9L, the tool retention members 15 are configured to be able to be move (advance and retract) in the front-rear direction (the Y-axis direction, the left-right direction in FIG. 2). Then, when the tool retention members are engaged with the engagement holes PH and DH of the tools P and D mounted on the tool mounting units 9U and 9L to retain the tools P and D, the tool retention members 15 are retained in a state of advancing in a horizontal state. When the tool retention members 15 that retains the tools P and D are retained in the advancing state and the respective ATCs 13UL, 13UR, 13LL, and 13LR are moved in the left-right direction, the upper and lower tools P and D mounted on the tool mounting units 9U and 9L can be moved in the left-right direction.

Further, the respective ATCs 13UL, 13UR, 13LL, and 13LR move the tool retention members 15 in the front-rear direction in a region in which the tools P and D of the tool mounting units 9U and 9L have not been mounted, and retain the tool retention members 15 in the advancing state. When the tool retention members 15 retained in the advancing state are moved in the left-right direction, the tool retention members 15 can be abutted from the left-right direction against side surfaces of the tools P and D mounted on the tool mounting units 9U and 9L, respectively.

It should be noted that the operation of the ATCs 13U and 13L to move in the left-right direction and the operation of performing the installation and removal of the tools P and D between the tool mounting units 9U and 9L and tool storage units 17U and 17L are already well known as described in Patent Literature 1, for example. Therefore, a detailed description of the operation of the ATCs will be omitted.

Figure 3:
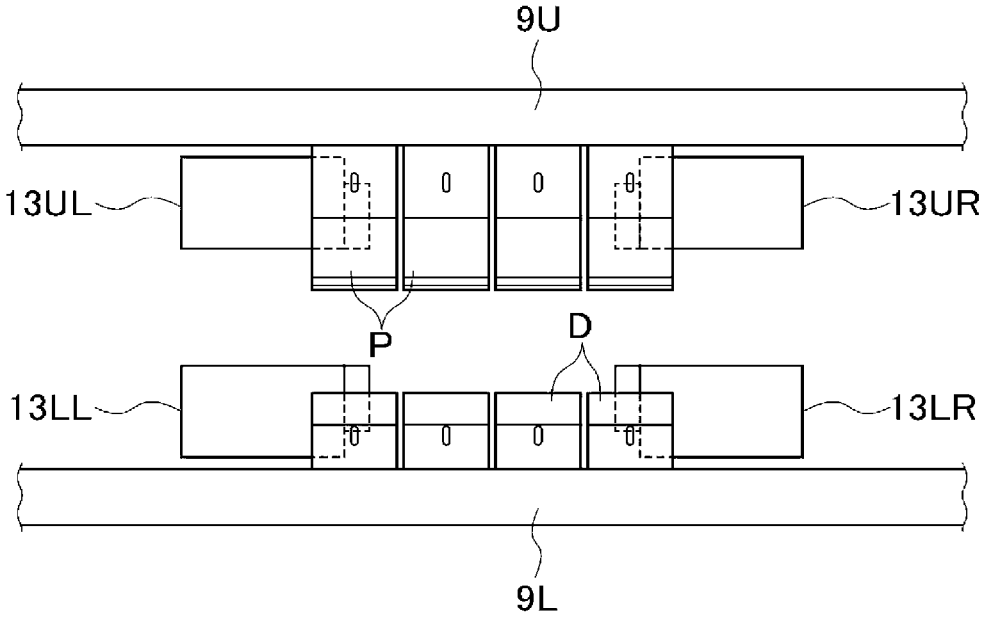
FIG. 3 is an explanatory diagram of gaps formed between the tools.

Now, when the upper and lower tools P and D are mounted on the upper and lower tool mounting units 9U and 9L by using the upper and lower ATCs 13UL, 13UR, 13LL, and 13LR, the following is performed. That is, as conceptually shown in FIG. 3, position control of the upper and lower ATCs 13UL, 13UR, 13LL, and 13LR is performed under the control of the control device so as to arrange the upper and lower tools P and D at desired positions. In this case, as shown in FIG. 3, small gaps may occur between the respective tools P and D due to, for example, a backlash of a drive unit, a deflection of the finger 15, a drawing tolerance of the tools P and D being negative, and the like.

Then, the pulling operation may be performed to the ATCs 13UL and 13LL on one side, for example, by moving the ATCs 13UR and 13LR on another side toward the 13UL and 13LL on the one side. This pulling operation is performed by position control for positioning the ATCs 13UR and 13LR on the other side under the control of the control device. Therefore, even when the ATCs 13UR and 13LR are positioned at accurate positions by the position control, small gaps may remain between the respective tools P and D. In other words, the adjacent tools P and D may not be abutted (brought into contact) with each other.

Figure 4:
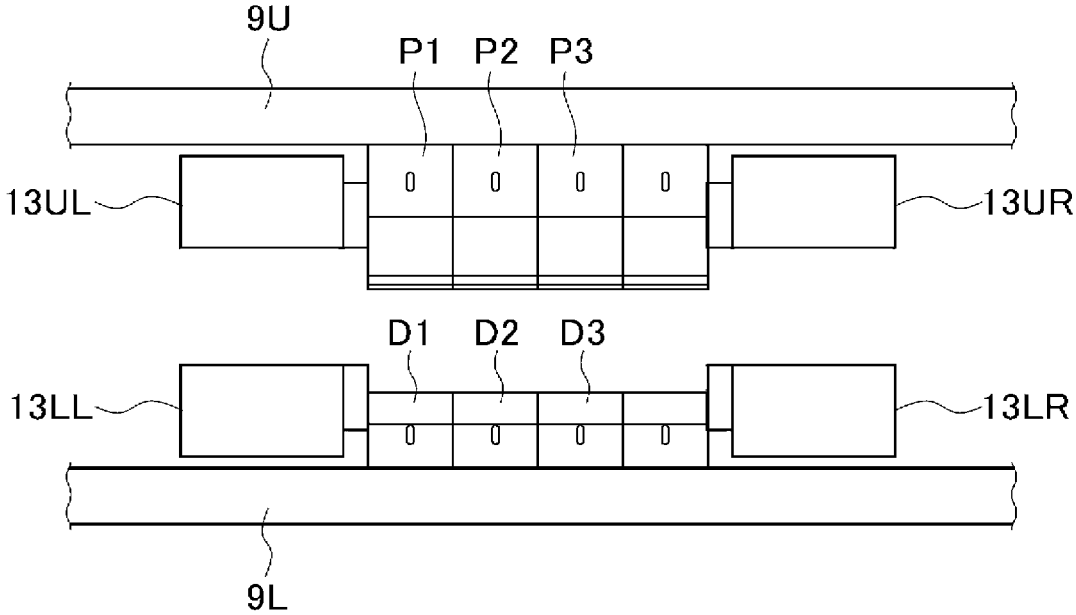
FIG. 4 is an explanatory diagram of a method according to the present embodiment.

Then, in the present embodiment, as shown in FIG. 4, the tools P1 and D1 on one end side of the tools P and D are positioned at predetermined positions (reference positions). Further, the tools P1 and D1 on the one end side are retained in an immobilized state by the ATCs 13UL and 13LL on the one side. Then, in close proximity to the tools P1 and D1 that are already mounted, separate tools P2, D2, P3, D3, . . . are mounted on the tool mounting units 9U and 9L by the ATCs 13UR and 13LR in a tentatively (temporarily) movable state. After that, the tools P2, P3, . . . , D2, D3, . . . are relatively pressed and moved in the directions of the ATCs 13UL and 13LL by means of the ATCs 13UR and 13LR.

At this time, a control device 21 that controls the operation of the ATCs 13UR and 13LR to press the tools P2, P3, . . . , D2, D3, . . . is configured as follows.

Figure 5:
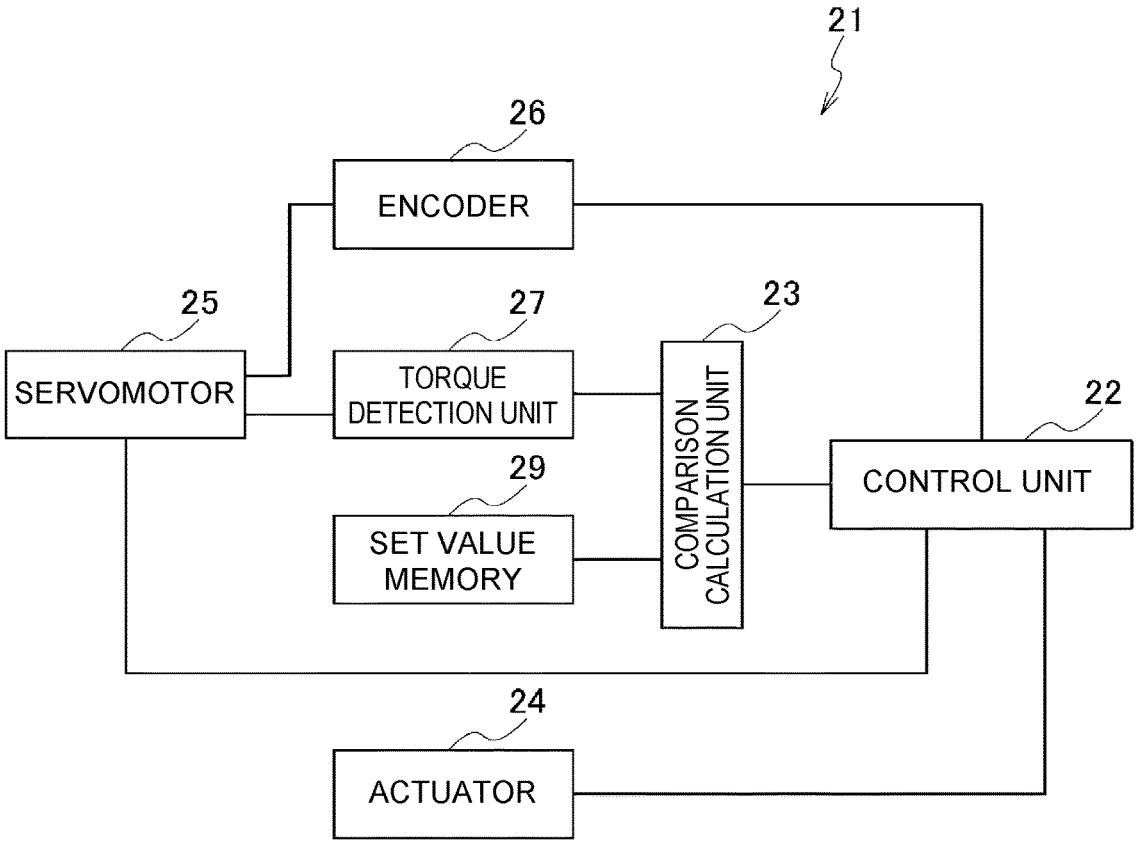
FIG. 5 is a block diagram showing a configuration of a control device.

The control device 21 is composed of, for example, a computer. As shown in FIG. 5, the control device 21 has respective functions of a control unit 22, a comparison calculation unit 23, and a set value memory 29.

The control unit 22 controls an actuator 24 that drives the tool retention members 15 of the ATCs 13UL, 13UR, 13LL, and 13LR, and performs position control of the tool retention members 15 in the front-rear direction. In the position control, the control unit 22 can recognize the position of each of the tool retention members 15 in the front-rear direction based on a detection signal supplied from an unillustrated sensor. By controlling the actuator 24, the control unit 22 can advance and retract the tool retention members 15 in the front-rear direction. Then, by the advancing and retracting operation of the tool retention members 15, the tool retention members 15 can be inserted into the engagement holes PH and DH of the tools P and D, and the tool retention members 15 can be taken out from the engagement holes PH and DH of the tools P and D.

The control unit 22 controls motors 25 (for example, servomotors 25) that drive the ATCs 13UL, 13UR, 13LL, and 13LR to perform position control of the ATCs 13UL, 13UR, 13LL, and 13LR in the left-right direction. In the position control, the control unit 22 can recognize the position of each of the ATCs 13LL, 13LR, 13UL, and 13UR in the left-right direction based on a detection signal supplied from an encoder 26 that detects a rotation speed of the motor 25. The control unit 22 can move the ATCs 13LL, 13LR, 13UL, and 13UR in the left-right direction by performing the position control. Then, the tools P and D can be arranged at the predetermined positions by the moving operation of the ATCs 13LL, 13LR, 13UL, and 13UR in the left-right direction.

A torque detection unit 27 provided in each of the motors 25 for moving each of the ATCs 13UR, 13LR, and the like is connected to the comparison calculation unit 23. Further, the set value memory 29 is connected to the comparison calculation unit 23. A preset set value of a torque is stored in the set value memory 29.

Then, a detected torque detected in the torque detection unit 27 and the set value of the torque stored in the set value memory 29 are compared in the comparison calculation unit 23. When the detected torque and the set torque are equal as a result of this comparison, a stop instruction signal is output to the motor 25 from the control unit 22 that is connected to the comparison calculation unit 23, and the movement of the motor 25 is stopped.

In other words, when a press force with which the ATCs 13UR and 13LR press the tools P2, P3, . . . , D2, D3, . . . reaches the preset set value, the pressing by the ATCs 13UR and 13LR is stopped.

The control device 21 that controls the operation of the press brake 1 includes the set value memory 29 that stores the preset torque and the comparison calculation unit 23 that compares the detected value of the torque with the set value. As a result, the respective tools P and D are pressed by a preset press force (torque), which causes the adjacent tools P1, P2, . . . , D1, D2, . . . to be abutted (brought into contact) with each other. Therefore, there are no gaps between the respective tools P1, P2, . . . , D1, D2, . . . as shown in FIG. 4.

The tools P1 and D1 on the one end side are positioned in advance at accurate positions by means of the position control. Then, the separate tools P2, P3, . . . , D2, D3, . . . , which are tentatively mounted in a separate manner, are pressed with the set predetermined press force so as to be abutted against the tools P1 and D1 each in a positioned state. Therefore, the adjacent respective tools P1, P2, . . . , D1, D2, . . . are arranged in a state of being in contact with each other. As a result, the problem caused by the existence of the minute gaps between the respective tools P1, P2, P3, . . . , D1, D2, D3, . . . can be solved. Note that when the separate tools P2 and D2 are abutted against the tools P1 and D1, the tools P1 and D1 are fixed to an immobile state by, for example, the ATCs 13UL and 13L on the one side.

Now, as a method of tentatively mounting the plurality of tools P and D by the ATCs 13U and 13L with respect to the tool mounting units 9U and 9L of the press brake so as to abut (bring into contact), with each other, the tools P and D adjacent to each other, the following methods are also available. That is, (A) every time one separate tool P and one separate tool D are tentatively mounted or every time predetermined numbers of tools P and D are tentatively mounted by the ATCs 13U and 13L with respect to the tool mounting units 9U 9L, the separate tools P and D are pressed and moved toward the tools P1 and D1, which are already mounted, so as to be abutted with each other.

In addition, (B) a desired number of tools P2, P3, . . . , D2, D3, . . . are tentatively mounted by the ATCs 13U and 13L with respect to the tool mounting units 9U and 9L, respectively. Then, the plurality of tools P2, P3, . . . , D2, D3, . . . are collectively moved in the direction of the tools P1 and D1 that are already mounted. Then, the tools P and D adjacent to each other are abutted with each other.

Furthermore, (C) a desired number of tools P and D are tentatively mounted by the ATCs 13UR and 13LR with respect to the tool mounting units 9U and 9L. Then, the plurality of tools P and D are collectively moved toward the tools P1 and D1 that are already mounted, and the tools P and D are abutted with each other. This process is repeated for a plurality of times. In other words, it is possible to press the desired number of tools P and D toward the tools P1 and D1 so as to abut the adjacent tools P and D with each other every time the desired number of tools P and D are grouped and the tools P and D of the respective groups are tentatively mounted by the ATCs 13U and 13L with respect to the tool mounting units 9U and 9L.

That is, there are various methods of tentatively mounting the plurality of divided tools P and D with respect to the tool mounting units 9U and 9L and mount the respective divided tools P and D in a state of being abutted (in contact) with each other.

Second Embodiment

A press brake according to a second embodiment will be described. The press brake 1 according to the present embodiment is different from the press brake 1 according to the first embodiment in that a method of the pulling operation is chosen. Descriptions that overlap with those of the first embodiment will be omitted, and the differences will be mainly described hereinafter.

When the tools P and D are mounted on the tool mounting units 9U and 9L or the arrangement of the tools P and D in the tool mounting units 9U and 9L is changed by means of the respective ATCs 13UL, 13UR, 13LL, and 13LR, the respective ATCs 13UL, 13UR, 13LL, and 13LR perform the same in a state in which the tool retention members 15 are engaged with the engagement holes PH and DH of the tools P and D, respectively.

On the other hand, as the possible methods of performing the pulling operation, there are a method of performing the pulling operation in a state in which the respective ATCs 13UL, 13UR, 13LL, and 13LR are abutted against the side surfaces of the tools P and D, and a method of performing the pulling operation in a state in which the respective ATCs 13UL, 13UR, 13LL, and 13LR are engaged with the engagement holes PH and DH of the tools P and D. Therefore, in the present embodiment, for each of the ATCs 13UL, 13UR, 13LL, and 13LR, whether to perform the pulling operation in a state of being abutted against the side surfaces of the tools P and D or to perform the polling operation in a state of being engaged with the engagement holes PH and DH of the tools P and D are chosen. Hereinafter, the choosing method will be described with reference to a plurality of patterns of the pulling operation.

In the following description, the tool mounting unit 9U, the tool P, and the ATCs 13UL and 13UR, all of which are on the upper side, are used. However, the method shown in the present embodiment can be applied, in the same manner, to the tool mounting unit 9L, the tool D, and the ATCs 13LL and 13LR that are on the lower side (the same applies to a third embodiment to be described later).

(First Pulling Operation Pattern)

Figure 6A:
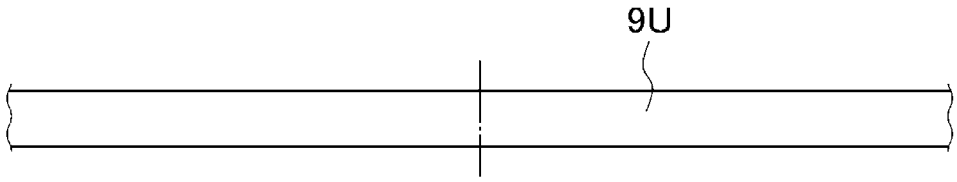
FIG. 6A is a diagram illustrating an operation pattern of a pulling operation.
Figure 6B:
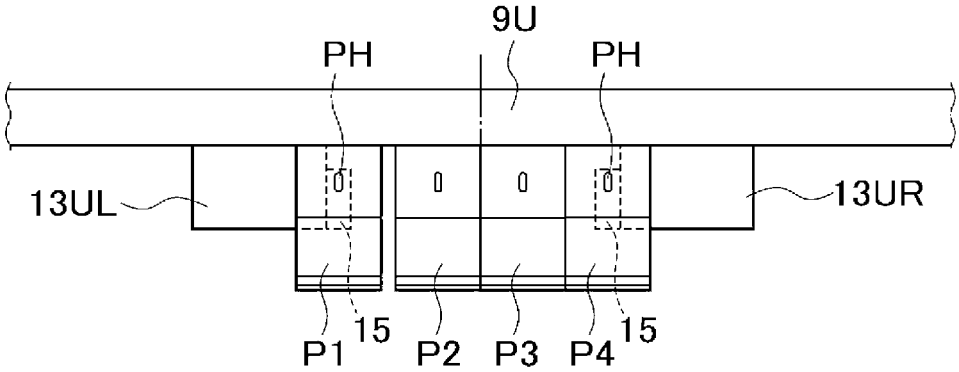
FIG. 6B is a diagram illustrating the operation pattern of the pulling operation.
Figure 6C:
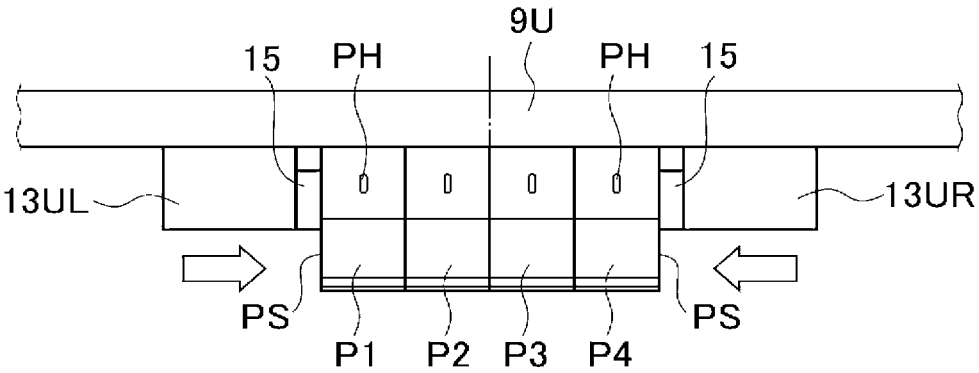
FIG. 6C is a diagram illustrating the operation pattern of the pulling operation.

With reference to FIGS. 6A to 6C, a method of mounting four tools P1 to P4 (P1, P2, P3, and P4) with respect to the tool mounting unit 9U will be described. Of the four tools P1 to P4, the tool P1 is the tool on a left end side (the one end side) in the left-right direction, and the tool P4 is the tool on a right end side (another end side) in the left-right direction. When the four tools P1 to P4 are collectively referred to, they are referred to as the tools P (the same applies hereinafter).

First, as shown in FIG. 6A, the tool P is not arranged on the tool mounting unit 9U in an initial state.

As shown in FIG. 6B, the control unit 22 controls the actuator 24 and the motors 25 to operate the ATCs 13UL and 13UR. As a result, the ATCs 13UL and 13UR move the four tools P1 to P4 from the tool storage unit 17U to the tool mounting unit 9U. Then, the ATCs 13UL and 13UR arrange the four tools P1 to P4 at the desired positions of the tool mounting unit 9U by means of position control. The movement and arrangement of the four tools P1 to P4 are performed in a state in which the tool retention members 15 of the ATCs 13UL and 13UR are inserted into the engagement holes PH of the tools P. Specifically, the tool retention member 15 of the ATC 13UL is inserted into the engagement hole PH of the leftmost tool P1, and the tool retention member 15 of the ATC 13UR is inserted into the engagement hole PH of the rightmost tool P4.

When the four tools P1 to P4 are arranged by means of the position control, the pulling operation is performed to reduce gaps between the four tools P1 to P4. As shown in the first embodiment, the pulling operation is an operation in which the tool P1 is retained in an immovable state by the left ATC 13UL and the tool P4 is moved toward the left ATC 13UL by the right ATC 13UR.

When the pulling operation is performed by the ATCs 13UL and 13UR, whether to perform the pulling operation in the state in which the tool retention member 15 is engaged with the engagement hole PH of the tool P1 or to perform the pulling operation in the state in which the tool retention member 15 is abutted against the side surface PS of the tool P1 is chosen.

Figure 7A:
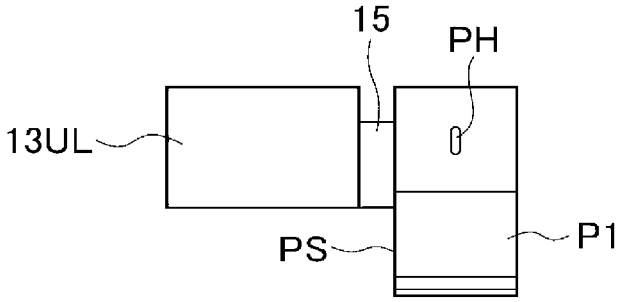
FIG. 7A illustrates a method of retaining the tool in an immobile state.
Figure 7B:
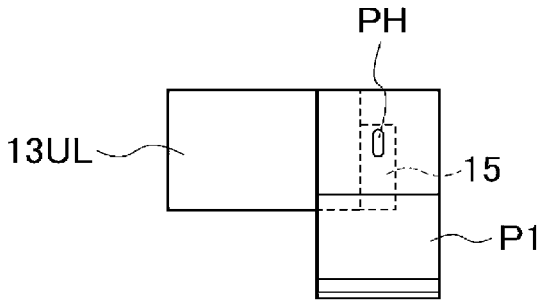
FIG. 7B illustrates the method of retaining the tool in an immobile state.
Figure 8A:
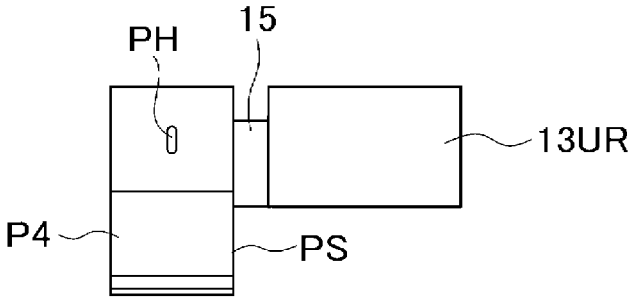
FIG. 8A is an explanatory diagram illustrating a method of moving the tool.
Figure 8B:
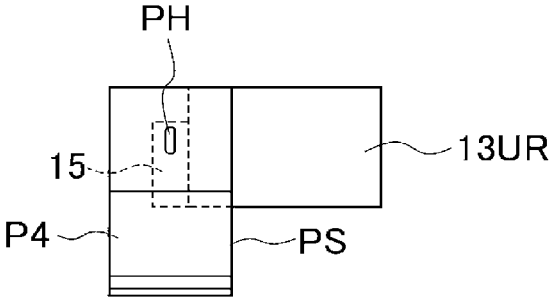
FIG. 8B is an explanatory diagram illustrating the method of moving the tool.

Specifically, whether to retain the tool P1 in an immovable state in a state in which the tool retention member 15 of the left ATC 13UL is abutted against the side surface PS of the tool P1 (see FIG. 7A) or to retain the tool P1 in an immovable state in a state in which the tool retention member 15 of the left ATC 13UL is engaged with the engagement hole PH of the tool P1 (see FIG. 7B) is chosen. In the same manner, whether to move the tool P4 in a state in which the tool retention member 15 of the right ATC 13UR is abutted against the side surface PS of the tool P4 (see FIG. 8A) or to move the tool P4 in a state in which the tool retention member 15 of the right ATC 13UR is engaged with the engagement hole PH of the tool P1 (see FIG. 8B) is chosen.

For the ATC 13UL that retains the tool P1 in an immovable state, either method of the method of engaging the tool retention member 15 with the engagement hole PH of the tool P1 or the method of abutting the tool retention member 15 against the side surface PS of the tool P1 can be chosen.

On the other hand, for the ATC 13UR that moves the tool P4, the method of abutting the tool retention member 15 against the side surface PS of the tool P4 is chosen. For the ATC 13UR that moves the tool P4, a torque change of the motor 25 is used when the movement of the ATC 13UR is stopped. However, when the position of the tool retention member 15 is displaced vertically with respect to the engagement hole PH and the tool retention member 15 strongly interferes with the engagement hole PH, a load is generated to the tool retention member 15. This load can be a disturbance when the torque change of the motor 25 is monitored. Therefore, for the ATC 13UR that moves the tool P4, it is preferable to choose the method of abutting the tool retention member 15 against the side surface PS of the tool P4.

However, for the ATC 13UR that moves the tool P4, the method of engaging the tool retention member 15 with the engagement hole PH of the tool P4 may also be chosen. In this case, the operation in which the tools P1 to P4 are arranged on the tool mounting unit 9U can be directly shifted to the pulling operation. As a result, work efficiency can be improved.

The choice of the method for the pulling operation may be made autonomously by the control unit 22 by retaining the above-mentioned concept as control information, or an operator of the press brake 1 may make a choice and instruct the result of the choice to the control unit 22.

When the method for the pulling operation is chosen, the control unit 22 controls the actuator 24 and the motors 25 to operate the ATCs 13UL and 13UR according to the chosen method. As a result, as shown in FIG. 6C, the left ATC 13UL retains the tool P1 in an immobile state, and the right ATC 13UR moves the tool P4 toward the left ATC 13UL.

When the right ATC 13UR starts moving, the detected torque detected in the torque detection unit 27 and the set value of the torque stored in the set value memory 29 are compared in the comparison calculation unit 23. When the result of this comparison shows that the detected torque and the set torque are equal, the control unit 22 outputs the stop instruction signal to the motor 25 that drives the right ATC 13UR, and the movement of the right ATC 13UR is stopped. The respective tools P1 to P4 are pressed by the preset press force (torque), which causes the adjacent tools P1 to P4 to be abutted (brought into contact) with each other. Therefore, there are no gaps between the respective tools P1 to P4.

(Second Pulling Operation Pattern)

With reference to FIGS. 9A to 9D, a description will be given on a method of mounting eight tools P1 to P8 on the tool mounting unit 9U by adding four tools P5 to P8 (P5, P6, P7, and P8) to the tools P that have already been mounted. Of the eight tools P1 to P8, the tool P1 is the tool on the left end side (the one end side) in the left-right direction, and the tool P8 is the tool on the right end side (the other end side) in the left-right direction.

Figure 9A:
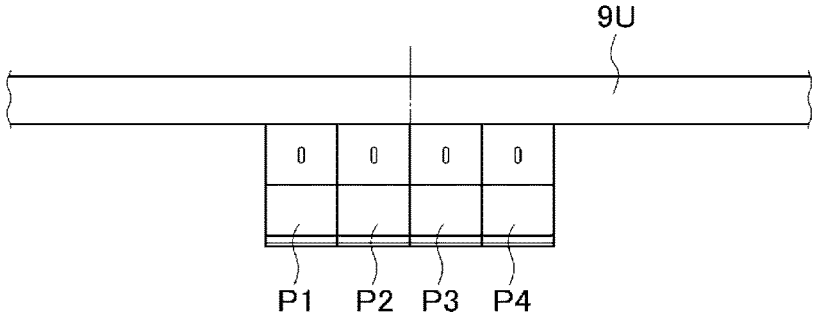
FIG. 9A is a diagram illustrating an operation pattern of the pulling operation.

First, as shown in FIG. 9A, the four tools P1 to P4 are mounted on the tool mounting unit 9U in an initial state.

Figure 9B:
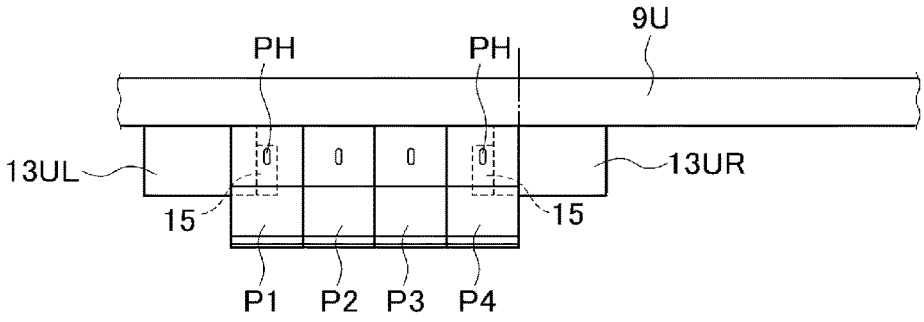
FIG. 9B is a diagram illustrating the operation pattern of the pulling operation.

As shown in FIG. 9B, the control unit 22 controls the actuator 24 and the motors 25 to operate the ATCs 13UL and 13UR. As a result, the ATCs 13UL and 13UR move the tools P1 to P4, which have already been mounted, according to the final arrangement of the eight tools P1 to P8. Then, the ATCs 13UL and 13UR arrange the tools P1 to P4, which have already been mounted, at desired positions of the tool mounting unit 9U by means of position control. The movement and arrangement of the four tools P1 to P4 are performed in a state in which the tool retention members 15 of the ATCs 13UL and 13UR are inserted into the engagement holes PH of the tools P. Specifically, the tool retention member 15 of the ATC 13UL is inserted into the engagement hole PH of the leftmost tool P1, and the tool retention member 15 of the ATC 13UR is inserted into the engagement hole PH of the rightmost tool P4.

Figure 9C:
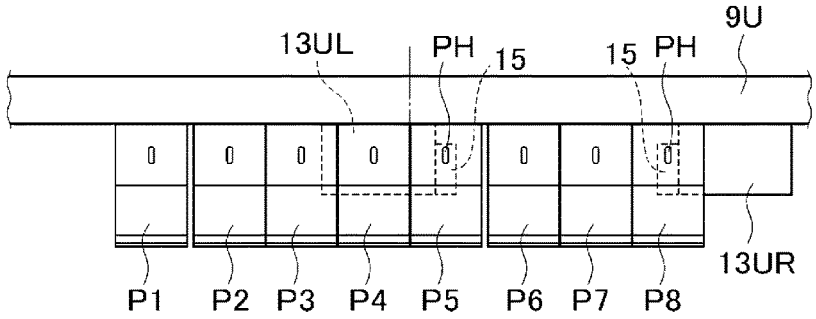
FIG. 9C is a diagram illustrating the operation pattern of the pulling operation.

Next, as shown in FIG. 9C, the control unit 22 controls the actuator 24 and the motors 25 to operate the ATCs 13UL and 13UR. As a result, the ATCs 13UL and 13UR move the additional tools P5 to P8 from the tool storage unit 17U to the tool mounting unit 9U. Then, the ATCs 13UL and 13UR arrange the additional tools P5 to P8 at desired positions of the tool mounting unit 9U by means of the position control. The movement and arrangement of the four tools P5 to P8 are performed in a state in which the tool retention members 15 of the ATCs 13UL and 13UR are inserted into the engagement holes PH of the tools P. Specifically, the tool retention member 15 of the ATC 13UL is inserted into the engagement hole PH of the leftmost tool P5 and the tool retention member 15 of the ATC 13UR is inserted into the engagement hole PH of the rightmost tool P.

When the eight tools P1 to P8 are arranged by means of the position control, the pulling operation is performed to reduce gaps between the eight tools P1 to P8. The pulling operation is an operation in which the tool P1 is retained in an immobile state by the left ATC 13UL and the tool P8 is moved toward the left ATC 13UL by the right ATC 13UR.

In a similar manner as the first pulling operation pattern, the method for the pulling operation is chosen for each of the ATCs 13UL and 13UR.

First, for the ATC 13UL that retains the tool P1 in an immovable state, either method of the method of engaging the tool retention member 15 with the engagement hole PH of the tool P1 or the method of abutting the tool retention member 15 against the side surface PS of the tool P1 can be chosen.

For the ATC 13UR that moves the tool P8, it is preferable to choose the method of abutting the tool retention member 15 against the side surface PS of the tool P8 in consideration of the disturbance to the torque change of the motor 25. However, for the ATC 13UR that moves the tool P8, the method of engaging the tool retention member 15 with the engagement hole PH of the tool P4 may also be chosen.

Figure 9D:
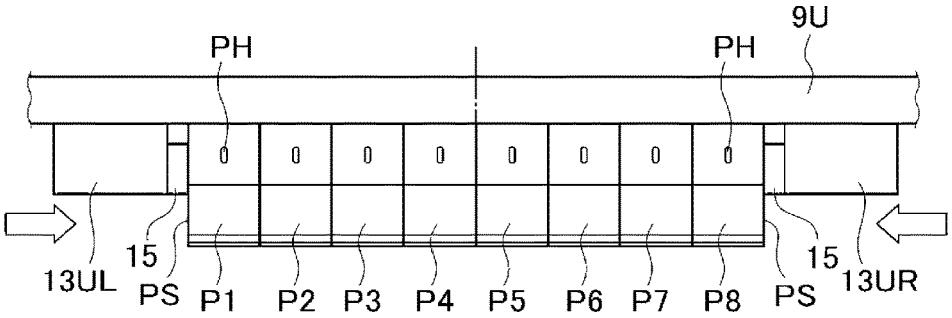
FIG. 9D is a diagram illustrating the operation pattern of the pulling operation.

When the method for the pulling operation is chosen, the control unit 22 controls the actuator 24 and the motors 25 to operate the ATCs 13UL and 13UR according to the chosen method. As a result, as shown in FIG. 9D, the left ATC 13UL retains the tool P1 in an immobile state, and the right ATC 13UR moves the tool P8 toward the left ATC 13UL.

When the right ATC 13UR starts moving, the movement of the right ATC 13UR is stopped based on the detected torque detected in the torque detection unit 27. As a result, the respective tools P1 to P4 are pressed by the preset press force (torque), which causes the adjacent tools P1 to P8 to be abutted (brought into contact) with each other. Therefore, there are no gaps between the respective tools P1 to P8.

The two pulling operation patterns as described above are the basic operations when the pulling operation is performed. In these basic operations, the method for the pulling operation is determined depending on a mode of the pulling operation by means of the ATCs 13UL and 13UR, that is, whether the ATCs 13UL and 13UR play a role of retaining the tool P in an immobile state or the ATCs 13UL and 13UR play a role of moving the tool P.

Next, with reference to various application examples, a method of choosing the method for the pulling operation will be described in consideration of a state of the tool P mounted on the tool mounting unit 9U.

First Application Example

Figure 10A:
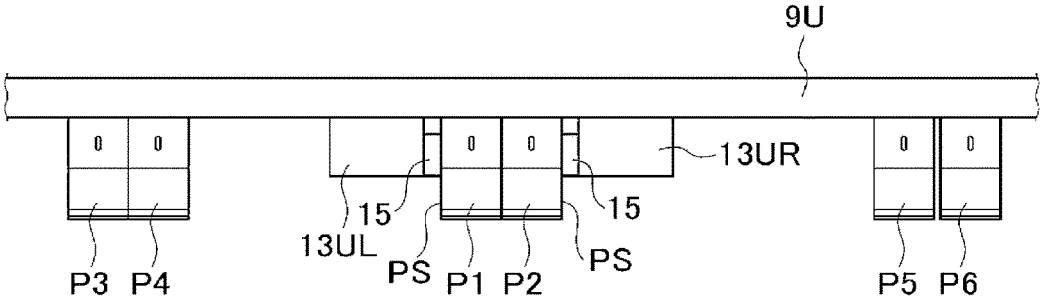
FIG. 10A is a diagram schematically showing gaps between the stages.
Figure 10B:
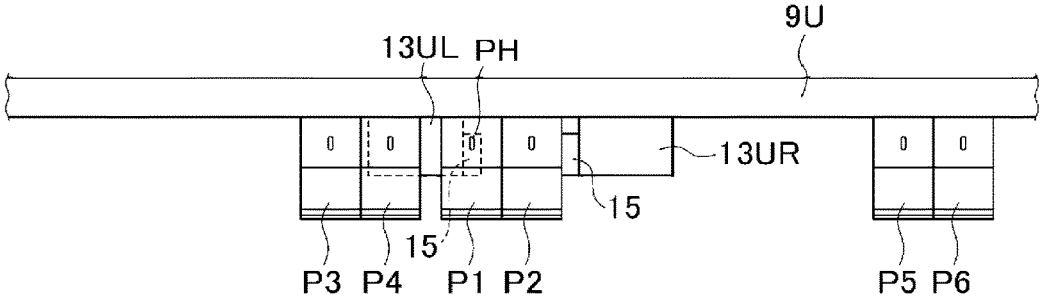
FIG. 10B is a diagram schematically showing gaps between the stages.

As shown in FIGS. 10A and 10B, a plurality of stages may be arranged on the tool mounting unit 9U. FIGS. 10A and 10B illustrates a first stage that includes two tools P1 and P2, a second stage that includes two tools P3 and P4, and a third stage that includes two tools P5 and P6. The second stage is arranged on the left side of the first stage, and the third stage is arranged on the right side of the first stage.

The respective stages are arranged on the tool mounting unit 9U by means of position control, and the pulling operation is performed for each of the plurality of stages. Hereinafter, the pulling operation for the first stage will be described, but the same applies to the stages other than the first stage.

First, it is determined whether or not there is a gap having a reference width between the tool P1 for which the left ATC 13UL performs the pulling operation and the adjacent stage, that is, the second stage. The reference width is a value that defines the width of a gap into which the tool retention member 15 can be inserted. For example, as the reference width, a value is set that is obtained by adding a predetermined margin to the width of the tool retention member 15 in the left-right direction.

When there is a gap equal to or larger than the reference width between the tool P1 and the second stage (the tool P4) as shown in FIG. 10A, either method of the method of engaging the tool retention member 15 with the engagement hole PH of the tool P1 or the method of abutting the tool retention member 15 against the side surface PS of the tool P1 can be chosen.

On the other hand, when there is no gap equal to or larger than the reference width between the tool P1 and the second stage (the tool P4) as shown in FIG. 10B, the method of engaging the tool retention member 15 with the engagement hole PH of the tool P1 is chosen.

For the right ATC 13UR, a method of performing the pulling operation based on a gap between the tool P2 for which the pulling operation is performed and the adjacent stage, that is, the third stage (the tool P5) is also chosen.

Second Application Example

Due to a displacement of the tool P, the tool P may be located at a position different from the assumption of the control device 21. Hereinafter, situations in which a displacement occurs will be illustrated.

Figure 11A:
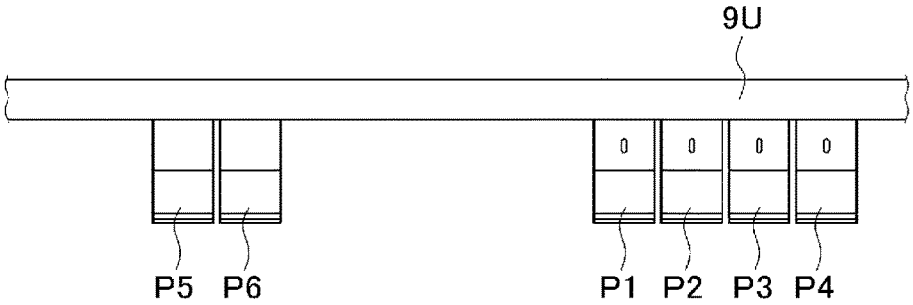
FIG. 11A is a diagram illustrating a displacement that occurs in the tool.

First, the first situation occurs when the tool mounting unit 9U is switched from a clamped state to an unclamped state. For example, as shown in FIG. 11A, it is assumed that four tools P1 to 4 are mounted on the tool mounting unit 9U. When the tool mounting unit 9U is switched from the clamped state to the unclamped state, the retention force by the tool mounting unit 9U is released. As a result, the postures of the tools P1 to P4 may be displaced, and the positions of the tools P1 to P4 may be displaced from the original positions.

The second situation occurs when the operator manually attaches the tool P. As shown in FIG. 11A, when the tools P5 and P6 that do not include the engagement holes PH are to be mounted on the tool mounting unit 9U, it is not possible to automatically arrange the tools P5 and P6 by means of the ATCs 13UL and 13UR. Therefore, it is necessary for the operator to manually attach the tools P5 and P6. However, depending on the operator, the tools P5 and P6 may not be arranged at accurate locations, and the positions of the tools P5 and P6 may be displaced from the original positions. Even so, it is also possible for the operator to manually attach the tool P that includes the engagement hole PH.

Figure 11B:
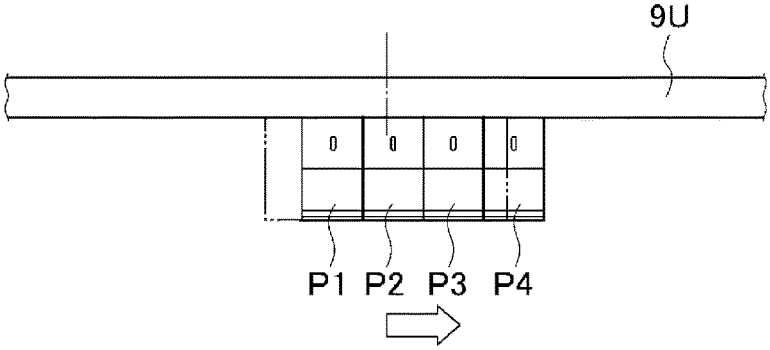
FIG. 11B is a diagram illustrating the displacement that occurs in the tool.

Further, the third situation occurs when the tool P is moved during processing. If a thick plate or the like is bent repeatedly with a large pressurizing force, the position of the tool P may be displaced. For example, as shown in FIG. 11B, the position of the tools P1 to P4 after processing is displaced from the original tool position (shown in the dashed-dotted line).

In the case of the above situations, the tools P cannot be stored in the tool storage unit 17U by the ATCs 13UL and 13UR. Thus, the control device 21 rearranges the tools P and performs the pulling operation in accordance with the rearrangement of the tools P before storing the tools P.

Figure 12A:
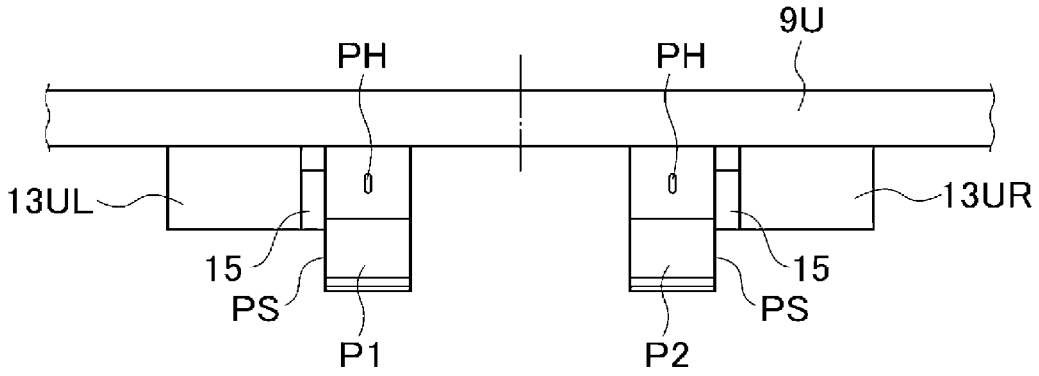
FIG. 12A is a diagram illustrating an operation pattern of the pulling operation.

First, as shown in FIG. 12A, a situation is assumed in which the two tools P1 and P2 mounted on the tool mounting unit 9U are moved for some reason and exist at distant positions.

Figure 12B:
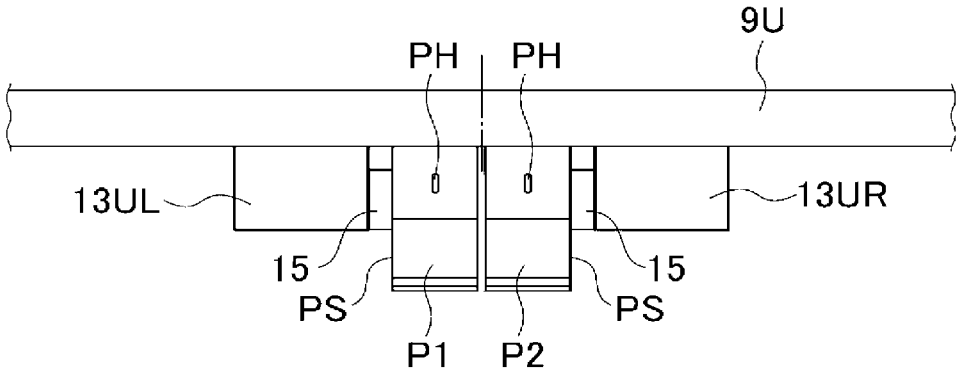
FIG. 12B is a diagram illustrating the operation pattern of the pulling operation.

As shown in FIG. 12B, the control unit 22 controls the actuator 24 and the motors 25 to operate the ATCs 13UL and 13UR. As a result, the ATCs 13UL and 13UR push the side surfaces PS of the tools P1 and P2 to move the tools P1 and P2 to theoretically accurate positions. Specifically, the left ATC 13UL moves the tool P1 toward the right ATC 13UR, and moves the tool P1 to the theoretically accurate position. Further, the right ATC 13UR moves the tool P2 toward the left ATC 13UL, and moves the tool P2 to the theoretically accurate position. The movements of the ATCs 13UL and 13UR are performed by means of the position control.

After the two tools P1 and P2 are arranged by means of the position control, the pulling operation is performed to reduce a gap between the two tools P1 and P2. The pulling operation is an operation in which the tool P1 is retained in an immobile state by the left ATC 13UL and the tool P2 is moved toward the left ATC 13UL by the right ATC 13UR.

In this pulling operation, the method of performing the pulling operation in a state in which the tool retention members 15 are abutted against the side surfaces of the tools P1 and P2 is chosen for each of the ATCs 13UL and 13UR.

Figure 12C:
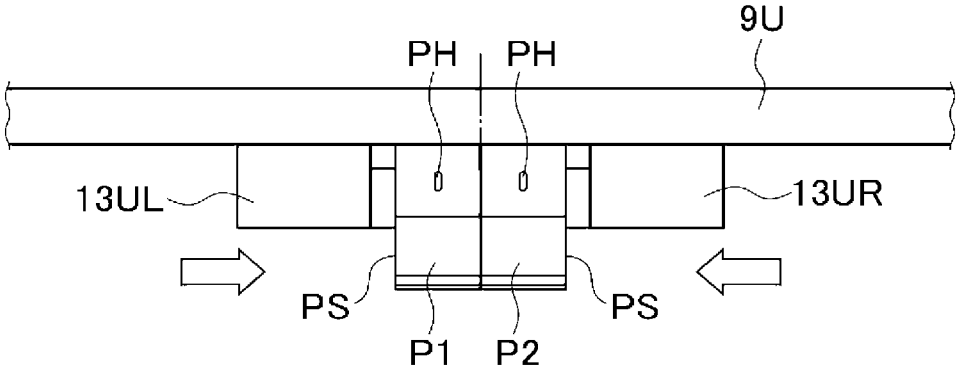
FIG. 12C is a diagram illustrating the operation pattern of the pulling operation.

When the method is chosen in this manner, the control unit 22 controls the actuator 24 and the motors 25 to operate the ATCs 13UL and 13UR according to the chosen method. As a result, as shown in FIG. 12C, the left ATC 13UL retains the tool P1 in an immobile state and the right ATC 13UR moves the tool P2 toward the left ATC 13UL.

When the right ATC 13UR starts moving, the movement of the right ATC 13UR is stopped based on a detected torque detected by the torque detection unit 27. The respective tools P1 and P2 are pressed by the preset press force (torque), which causes the adjacent tools P1 and P2 to be abutted (brought into contact) with each other. Therefore, there is no gap between the respective tools P1 and P2.

As described above, according to the present embodiment, the pulling operation can be performed by the appropriate methods that correspond to the various situations. As a result, effectiveness of the pulling operation can be enhanced.

Particularly, when the tool P mounted on the tool mounting unit 9U of the press brake 1 is displaced, it is conceivable that the tool retention member 15 cannot be engaged with the engagement hole PH and thus the pulling operation cannot be performed in the state in which the tool retention member 15 is engaged with the engagement hole PH. Further, when the movement (the pulling operation) of the tool P is performed in the state in which the tool retention member 15 is engaged with the engagement hole PH, a disturbance may be generated to the torque change of the motors 25 of the ATCs 13UL and 13UR that move the tools P.

However, in the methods shown in the present embodiment, it is possible to choose whether to use the method of engaging the ATCs 13UL and 13UR (the tool retention members 15) with the engagement holes PH of the tools P or the method of abutting the ATCs 13UL and 13UR (the tool retention members 15) against the side surfaces PS of the tools P. As a result, the pulling operation for the tool P can be appropriately performed.

It should be noted that the pulling operation does not have to be performed every time the tool P is arranged on the tool mounting unit 9U, and may be executed when a predetermined trigger condition for determining execution of the pulling operation is satisfied. The trigger condition is, for example, when a plurality of tools P constituting the respective stages are gathered. Further, the trigger condition is, for example, when the tool P displaced from the original position is rearranged. The conceivable situations in which the tool P is displaced from the original arrangement include, as described above, the situation when the tool mounting unit 9U is switched from the clamped state to the unclamped state, the situation when the operator manually attaches the tool P, the situation when the bending with the large pressurizing force is repeated, and the like. Therefore, when these situations occur, it can be determined that the tool P is displaced from the original arrangement. Further, it can be determined that the tool P is displaced from the original arrangement when the tool retention member 15 is advanced toward the tool P but the tool retention member 15 cannot be inserted into the engagement hole PH of the tool P. The trigger condition may be autonomously determined by the control unit 22. Alternately, the operator of the press brake 1 may determine the trigger condition and instruct the control unit 22 to execute the pulling operation.

Third Embodiment

A press brake according to a third embodiment will be described. The press brake 1 according to the present embodiment is different from the press brake 1 according to the second embodiment in that a separation operation is performed after the pulling operation. Descriptions that overlap with those of the second embodiment will be omitted, and the differences will be mainly described hereinafter.

Figure 13A:
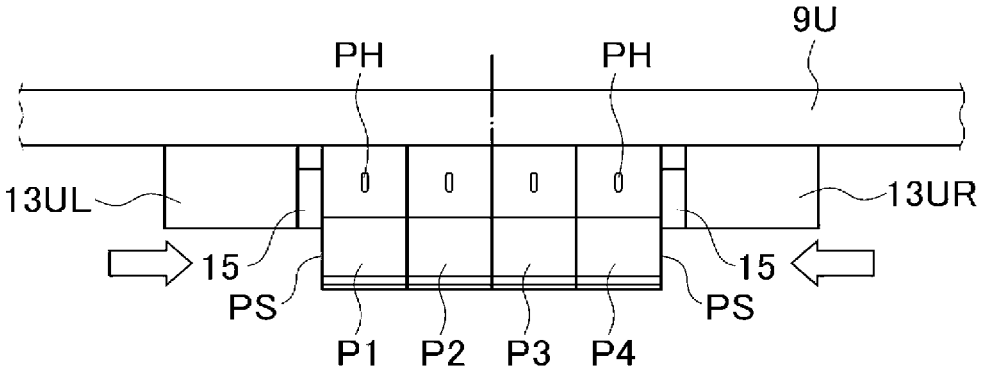
FIG. 13A is a diagram illustrating a flow of a separation operation.

FIG. 13A shows a state in which the left and right ATCs 13UL and 13UR perform the pulling operation to four tools P1 to P4. The ATCs 13UL and 13UR perform the pulling operation by the method of abutting the tool retention members 15 against the side surfaces PS of the tools P1.

When the movement of the right ATC 13UR is stopped and the pulling operation is ended, the control unit 22 controls the actuator 24 to switch the tool retention members 15 that is in an advancing state to a retracting state. As a result, the tool retention members 15 move backward, thereby causing the tool retention members 15 to retract from the tools P1 and P4.

Now, in a state in which the pulling operation is ended, the left and right ATCs 13UL and 13UR are still in a state of pressing the four tools P1 to P4 from both sides. Therefore, when the tool retention members 15 move backward, an external force may act on the tools P1 to P4 and cause the position of the tools P1 to P4 to be displaced.

Figure 13B:
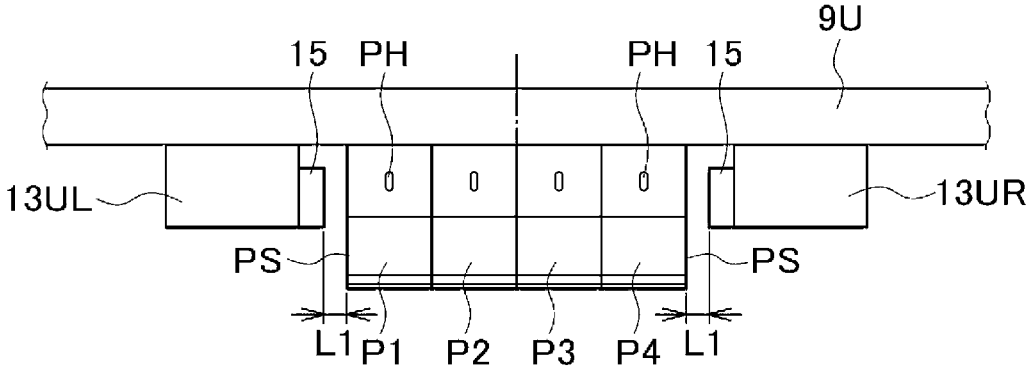
FIG. 13B is a diagram illustrating the flow of the separation operation.

Thus, in the present embodiment, a separation operation is performed to the ATCs 13UL and 13UR by the control unit 22 that controls the motors 25 after the movement of the right ATC 13UR is stopped. When the separation operation is performed, the ATCs 13UL and 13UR are moved in the direction of being separated from the tools P1 and P4 by a certain distance L1 by means of the position control (see FIG. 13B).

As described above, according to the present embodiment, it is possible to suppress the displacement of the tools P that occurs after the pulling operation. As a result, effectiveness of the pulling operation can be enhanced.

The disclosure of the present application is related to the subject matter described in Japanese Patent Application No. 2019-223622 filed on Dec. 11, 2019, all of which are incorporated herein by reference.

The invention claimed is:

1. A method of arranging a divided tool, the method arranging a plurality of divided tools with respect to a tool mounting unit in a press brake by using a first automatic tool changer and a second automatic tool changer for performing installation and removal of a divided tool to and from the tool mounting unit by retaining the divided tool in a state of being engaged with an engagement hole in a front-rear direction provided to the divided tool, the method comprising:

a first step of performing a pulling operation with respect to the plurality of divided tools by retaining, in an immovable state, a divided tool on one end side in a left-right direction from among the plurality of divided tools lined up on the tool mounting unit by means of the second automatic tool changer and by moving, toward the second automatic tool changer, a divided tool on another end side in the left-right direction from among the plurality of divided tools by means of the first automatic tool changer; and a second step of stopping a movement of the first automatic tool changer when a torque of a motor for moving the first automatic tool changer in the left-right direction reaches a preset set value, the first step including a choosing step of choosing, for each of the first and second automatic tool changers, whether to perform the pulling operation in a state of being abutted against a side surface of the divided tool or to perform the pulling operation in a state of being engaged with an engagement hole of the divided tool.

2. The method of arranging a divided tool according to claim 1, wherein the choosing step is performed based on a mode of the pulling operation by means of the first and second automatic tool changers or a state of the tool mounted on the tool mounting unit.

3. A method of arranging a divided tool, the method arranging a plurality of divided tools with respect to a tool mounting unit in a press brake by using a first automatic tool changer and a second automatic tool changer for performing installation and removal of a divided tool to and from the tool mounting unit by retaining the divided tool in a state of being engaged with an engagement hole in a front-rear direction provided to the divided tool, the method comprising:

a first step of performing a pulling operation with respect to the plurality of divided tools by retaining, in an immovable state, a divided tool on one end side in a left-right direction by means of the second automatic tool changer abutted against a side surface of the divided tool on the one end side from among the plurality of divided tools lined up on the tool mounting unit and by moving, toward the second automatic tool changer, a divided tool on another end side in the left-right direction by means of the first automatic changer abutted against a side surface of the divided tool on the other end side from among the plurality of divided tools;

a second step of stopping a movement of the first automatic tool changer when a torque of a motor for moving the first automatic tool changer in the left-right direction reaches a preset set value; and a third step of moving the first automatic tool changer in the left-right direction to separate the first automatic tool changer from the divided tool on the other end side and moving the second automatic tool changer in the left-right direction to separate the second automatic tool changer from the divided tool on the one end side.

4. The method of arranging a divided tool according to claim 1, wherein the first step is executed when a predetermined trigger condition for determining execution of the pulling operation is satisfied.

5. A press brake, comprising:

a table provided with a tool mounting unit for mounting a divided tool;

a first automatic tool changer and a second automatic tool changer configured to mount the divided tool with respect to the tool mounting unit by retaining the divided tool in a state of being engaged with an engagement hole in a front-rear direction provided to the divided tool;

a control device configured to control the first and second automatic tool changers to perform a pulling operation with respect to a plurality of divided tools lined up on the tool mounting unit along a left-right direction; and a torque detection unit configured to detect a torque of a motor for moving the first automatic tool changer in the left-right direction, the control device being configured to choose, for each of the first and the second automatic tool chargers, whether to perform the pulling operation in a state of being abutted against a side surface of the dividing tool or to perform the pulling operation in a state of being engaged with the engagement hole of the dividing tool, perform the pulling operation by retaining, in an immovable state, a divided tool on one end side in the left-right direction from among the plurality of divided tools by means of the second automatic tool changer and moving, toward the second automatic tool changer, a divided tool on another end side in the left-right direction from among the plurality of divided tools by means of the first automatic tool changer, and compare a preset set value and a detected value detected by the torque detection unit and stop a movement of the first automatic tool changer when the detected value is equal to the set value.

6. The press brake according to claim 5, wherein the control device is configured to choose, based on a mode of the pulling operation by means of the first and second automatic tool changers or a state of the tool mounted on the tool mounting unit, whether to perform the pulling operation in the state of being abutted against the side surface of the divided tool or to perform the pulling operation in the state of being engaged with the engagement hole of the divided tool.

7. A press brake, comprising:

a table provided with a tool mounting unit for mounting a divided tool;

a first automatic tool changer and a second automatic changer configured to mount a plurality of divided tools with respect to the tool mounting unit by retaining the divided tool in a state of being engaged with an engagement hole in a front-rear direction provided to the divided tool;

a control device configured to control the first and second automatic tool changers to perform a pulling operation with respect to the plurality of divided tools lined up on the tool mounting unit along a left-right direction; and a torque detection unit configured to detect a torque of a motor for moving the first automatic tool changer in the left-right direction, the control device being configured to perform the pulling operation by retaining, in an immobile state, a divided tool on one end side in the left-right direction by means of the second automatic tool changer abutted against a side surface of the divided tool on the one end side from among the plurality of divided tools and moving, toward the second automatic tool changer, a divided tool on another end side in the left-right direction by means of the first automatic tool changer abutted against a side surface of the divided tool on the other end side from among the plurality of divided tools, compare a preset set value and a detected value detected by the torque detection unit and stop a movement of the first automatic tool changer when the detected value is equal to the set value, and after the movement of the first automatic tool changer is stopped, move the first automatic tool changer in the left-right direction to separate the first automatic tool changer from the divided tool on the other end side and move the second automatic tool changer in the left-right direction to separate the second automatic tool changer from the divided tool on the one end side.

8. The press brake according claim 5, wherein the control device is configured to perform the pulling operation when a predetermined trigger condition for determining execution of the pulling operation is satisfied.

* * * * *